US006000160A

United States Patent [19]

Riley

[11] Patent Number: 6,000,160

[45] **Date of Patent: *Dec. 14, 1999**

[54] COMPUTER GENERATED MOISTURE PROOF IDENTIFICATION BRACELET

[76] Inventor: James M. Riley, #4 Picardy La., St. Louis, Mo. 63124

[ * ] Notice: This patent is subject to a terminal disclaimer.

[21] Appl. No.: 08/949,578

[22] Filed: Oct. 14, 1997

[51] Int. Cl.[6] ..... A44C 5/00

[52] U.S. Cl. ..... 40/633; 283/75; 283/109

[58] Field of Search ..... 40/633; 283/74, 283/75, 80, 109, 900

[56] References Cited

U.S. PATENT DOCUMENTS

| | | | |
|---|---|---|---|
| Re. 33,616 | 6/1991 | Welsch | 428/57 X |
| 3,197,899 | 8/1965 | Twentier | 40/633 |
| 4,627,994 | 12/1986 | Welsch | 428/41 |
| 4,682,431 | 7/1987 | Kowalchuk . | |
| 4,696,843 | 9/1987 | Schmidt | 428/57 X |
| 4,956,931 | 9/1990 | Selke | 40/633 |
| 5,026,084 | 6/1991 | Pasfield | 283/75 |
| 5,045,426 | 9/1991 | Maierson et al. . | |
| 5,135,789 | 8/1992 | Schmidt | 428/61 X |
| 5,318,326 | 6/1994 | Garrison | 283/101 |
| 5,370,420 | 12/1994 | Khatib et al. | 283/81 |
| 5,383,686 | 1/1995 | Laurash | 283/81 |
| 5,418,026 | 5/1995 | Dronzek, Jr. et al. . | |
| 5,427,416 | 6/1995 | Birch | 283/75 X |
| 5,486,021 | 1/1996 | Laurash | 283/81 |
| 5,486,436 | 1/1996 | Lakes . | |
| 5,509,693 | 4/1996 | Kohls | 283/75 |
| 5,509,694 | 4/1996 | Laurash et al. | 283/81 |
| 5,518,787 | 5/1996 | Konkol . | |
| 5,524,934 | 6/1996 | Schwan et al. | 283/95 |
| 5,547,227 | 8/1996 | Laurash et al. | 283/81 |
| 5,586,788 | 12/1996 | Laurash | 283/81 |
| 5,595,404 | 1/1997 | Skees | 283/116 |
| 5,598,970 | 2/1997 | Mudry et al. | 229/305 |
| 5,601,313 | 2/1997 | Konkol et al. | 283/81 |
| 5,648,143 | 7/1997 | Mehta et al. . | |
| 5,653,472 | 8/1997 | Huddleston et al. | 283/75 |
| 5,662,976 | 9/1997 | Popat et al. . | |
| 5,687,903 | 11/1997 | Akridge et al. | 229/75 |

FOREIGN PATENT DOCUMENTS

WO 96/12618 5/1996 WIPO .

OTHER PUBLICATIONS

Sample of Avery Dennison DuraCard™ labels.
Avery Laminated Identification Cards #5361.
Sample of Standard Register labels.

*Primary Examiner*—Joanne Silbermann
*Attorney, Agent, or Firm*—Howell & Haferkamp, L.C.

[57] ABSTRACT

A multi-layer, laser printable, identification band blank comprises a first paper label portion for receiving a printed image and an adhesive backed transparent film layer approximately twice the width of the paper layer so that upon separation from a carrier, the transparent film may be folded over and completely encapsulate the paper layer to moisture proof it and protect it. The transparent film layer includes a pair of adhesive backed tabs at the ends to facilitate its attachment about a patient's wrist or ankle.

31 Claims, 2 Drawing Sheets

COMPUTER GENERATED MOISTURE PROOF IDENTIFICATION BRACELET

BACKGROUND AND SUMMARY OF THE INVENTION

Identification bands are used in many applications, including particularly in hospitals or the like for patients upon admission. In such instances, when a patient is admitted, information is taken from the patient with respect to his medical history, and, during the course of the patient's stay, it's not unlikely that various kinds of medications and treatments are given to the patient. For these reasons, and others, it is important to keep track of the patients in a reliable manner with an identification bracelet which will withstand the vagaries of a hospital environment.

As the admission and processing of patients in hospitals becomes more automated with computers, there has developed a need in the art for an identification band which may be secured about a patient's wrist or ankle, for example, and which is readily generated through the same computer system as is used to in-process the patient himself. Commonly, and at the present time, these computer systems routinely print admission forms on laser printers.

In the prior art, identification bands have tended to be ruggedized and moisture proofed in order to insure that they are not easily removed by either the staff or the patient, inadvertently or on purpose. Additionally, various arrangements have been provided in the prior art for moisture proofing these identification bands by overlying the band with a plastic film or surrounding it in a plastic sleeve or the like. Of course, this complex structure and arrangement requires time for a medical professional not only to assemble the patient identification band but also to apply it to the patient in a secure manner. As hospitals process patients in significant numbers, the time required to prepare and apply patient identification bands can be significant and requires more than a minor intrusion into a medical professional's daily task.

Still another problem with prior art identification bands is their relatively narrow width. This narrow width limits the font size of printing and thereby renders the band difficult to read. In many instances, the bands were hand lettered or manually typed which created additional problems relating to the physical handling of the bands and the resulting "readability" problems caused by illegible or mis-aligned printing or typing.

With the advent of computer systems, including laser printers, there have been attempts in the prior art to solve these needs, with varying degrees of success. For example, U.S. Pat. No. 4,682,431 discloses a continuous form admission record with an adhesive backed patient identification band which may be removed from the continuous form after the patient's name and any identifying data is printed thereon, the band folded over on itself for adhering adhesive backed portions of the band together, and then securing the band to a patient's wrist by folding it into a loop and Joining its ends by use of an adhesive tab. However, the construction of the '431 patented band has several drawbacks. One such drawback is that the data printed on the identification band remains exposed after the band is applied to a patient's wrist. While special, more expensive, types of paper or plastic stock may be used, which will help to minimize any obliteration or alteration of the data, this increases the cost of the band and does not provide a full solution. Furthermore, as the disclosure is best understood, the adhesive tab which secures the opposite end of the band to hold it in a loop appears to be nonoverlapping such that its integrity may be readily breached.

The inventor herein is also aware of prior art identification badges or cards formed in a multi-part form wherein a paper layer provides a surface for the printing of identification information including a person's name, and a second layer of adhesive backed film is oversized so that upon separation of the badge from a carrier, the transparent film may be folded over to overlie the card. As best known to the inventor, these name badges have been used and recommended in the prior art for convention name tags, membership cards and the like which may be directly pinned onto a wearer's clothing, slipped into a plastic carrier for pinning onto a wearer's person, or carried in a wallet, or otherwise affixed with separate supporting structure. This product is available commercially under the trademark DURACARD from Avery Dennison.

In order to solve these and other problems in the prior art, the inventor has succeeded in designing and developing an identification band blank formed as part of a multi-part, standard page-sized, form which is readily adaptable for use in recording a patient's admission to a hospital or other health care facility, for example. An upper portion of the page-sized form may be comprised simply of a matrix of adhesive backed identification labels which may be removed conveniently to adhere to the patient's utensils, hospital chart, room sign, etc. At the same time, another portion of this page-sized form includes multi-layered identification band blanks of the present invention. In its preferred embodiment, the page-sized form is comprised of two layers, a paper stock layer and an adhesive backed transparent film layer. The paper stock is suitable for accepting an image printed thereon by a laser printer or the like and can be relatively inexpensive paper stock as will be seen momentarily. With this construction, the band blank can be thought of as an "open system" form. By that is meant the band blank can be any standard, or special, paper or paper size for printing in any printer with any suitable ink.

The outline of the paper label may be kiss-cut into the paper stock such that only the paper stock portion of the multi-layer form is cut for separation from its surrounding paper layer. The transparent adhesive backed film which comprises the other half of the identification band blank is also kiss-cut but has a size more than twice the width of the paper label portion so that upon separation from the carrier, the transparent film may be folded along a fold line to completely overlay, surround, and encapsulate the paper label portion. An edge of adhesive backed film surrounds the entire circumference of the paper label so that a completely moistureproof seal is formed. Also, each "half" of the transparent film includes an adhesive backed tab extending from its edge so that as the transparent film is folded over, the identification band blank has an adhesive backed tab at either end and aligned for securing the band blank about a patient's wrist or ankle. As each of the tabs are adhesive backed, and they are arranged to join with each other on their adhesive surfaces, a rather secure attachment is provided when the patient's wrist is appropriately sized. However, in most instances this is not the case. As each tab has its own adhesive layer, the tabs need not overlie one another and instead will attach to other parts of the band blank such that the identification band blank may also be attached conveniently to a typically sized wrist.

In an alternative construction, a second set of kiss-cuts, of greater strength such that they are not as readily separated, may be formed in the identification band blank and used to provide a reduced length identification band blank for children or infants, as required. With this alternative construction, reduced inventory of the page-sized forms is permitted as the form may be used for virtually any patient being admitted to the hospital or other health care institution.

While many of the principal advantages and features have been briefly explained, a more thorough understanding of the invention may be obtained by referring to the drawings and description of the preferred embodiment which follows.

DETAILED DESCRIPTION OF THE PREFERRED EMBODIMENTS

Figure 1:
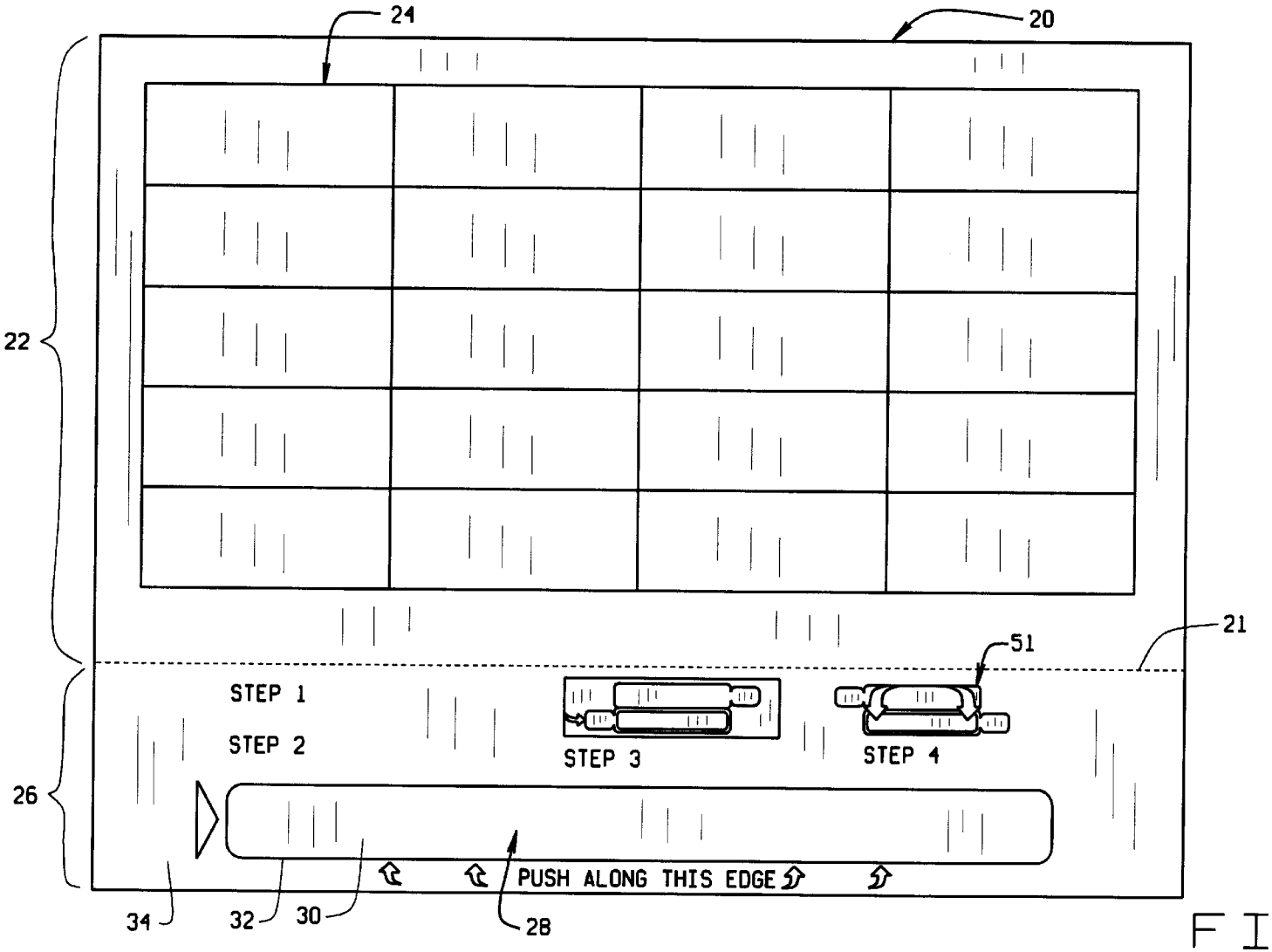
FIG. 1 is a top view of a page-sized form of the present invention illustrating the paper, image receivable, side of the form with instructions provided for separating the identification band blank and assembling it.

As shown in FIG. 1, a page-sized, multi-layered form 20 may be suitably sized for automatic feeding in a common laser printer, as known in the art. The page-sized form 20 is divided by performation 21 into a first portion 22, which may be practically anything as suited to the particular application, and second portion 26. For example, as illustrated in FIG. 1, a 4×5 matrix of individually die cut labels 24 may each be pre-printed with the patient's name, social security number, address, attending physician, date of admission, and even a bar code or other identifying indicia. These labels 24 may then be used as desired by the staff to identify the patient's articles, room, medicine containers, and other things for proper medical attention and for billing and administrative purposes as well. Second portion 26 of the form 20 includes the identification band blank 28. As viewed in FIG. 1, the paper stock element 30 is shown upon which an image may be printed by the laser printer, as mentioned above. The outline of the label 30 is defined by a dye cut 32 which may be a kiss-cut through the paper stock layer of multi-layer form 20, as known in the art. With a kiss-cut, the label portion 30 may be readily separated from the carrier 34 surrounding it and separated from it by kiss-cut 32.

Figure 3:
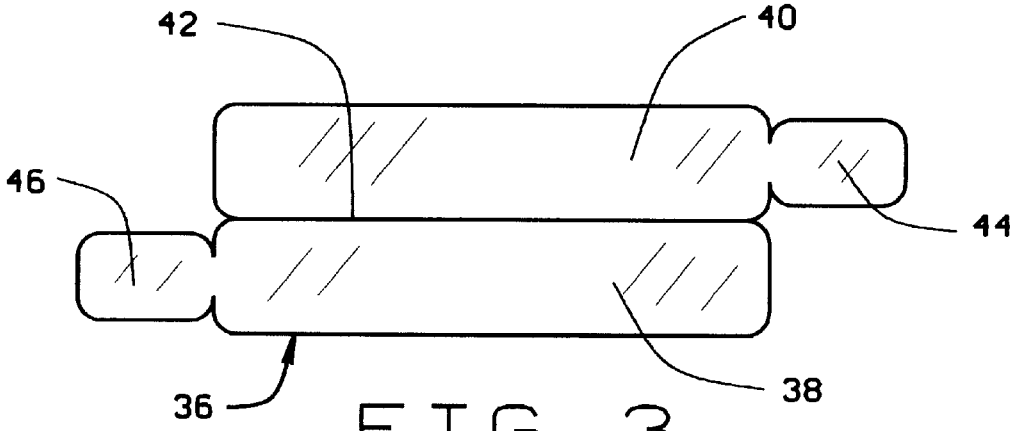
FIG. 3 is a plan view solely of the adhesive backed transparent film portion of the identification band blank.
Figure 4:
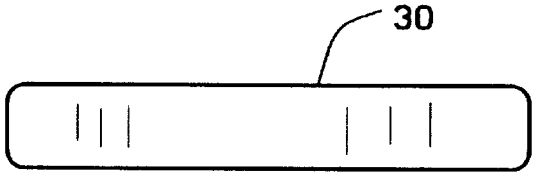
FIG. 4 is a plan view solely of the paper stock portion of the identification band blank.

As shown in FIG. 1, and FIG. 3, and as illustrated in the instructions on the attached Index A, the identification band blank 28 includes an adhesive backed, transparent film portion 36 having a lower half 38 separated from an upper half 40 by a fold line 42. Adhesive backed tabs 44, 46 are formed at one end of each of tabs 38, 40. Although not shown in FIG. 1, but similarly to the kiss-cut 32 provided to separate label portion 30 from carrier 34, another kiss-cut is made in the transparent film layer to allow for the ready separation of transparent film portion 36 from its surrounding carrier in the transparent film layer. A pair of notches 47, 49 are provided in the film portion 36 which are aligned with the fold line 42 which help to separate the film from the surrounding carrier and which also form a contour which follows the rounded edges of the paper label portion 30.

Figure 2:
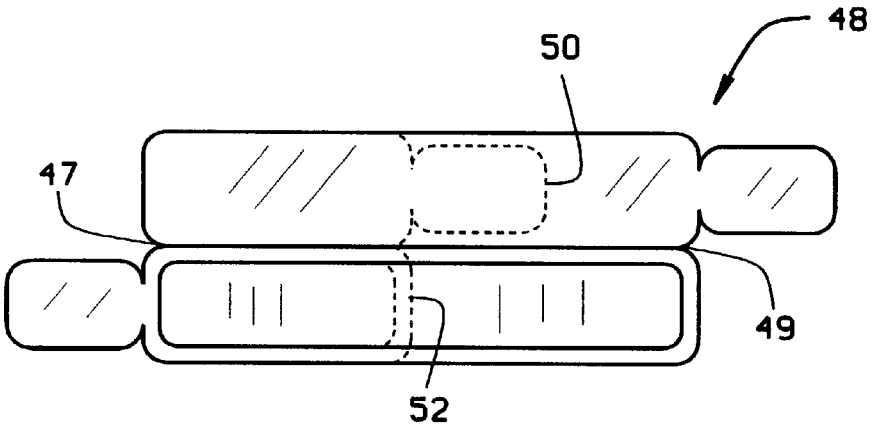
FIG. 2 is a plan view solely of the identification band blank with the additional mid-strength perforations of the alternative embodiment.

An alternative embodiment 48 is shown in FIG. 2. It includes, in addition to the kiss-cuts of the preferred embodiment, a second set of mid-strength perforations 50 and 52 which allow, with somewhat greater effort, a clean tearing away of a portion of the identification band blank in order to provide a smaller length version thereof. This is particularly helpful to accommodate smaller wrists such as those of infants and children. Also, this feature permits a single page-sized form 20 to be utilized as inventory and yet provide convenient and comfortable fit of the identification band bracelet 28 about infant's wrists as well. However, it should be noted that adhesive backed tabs 44, 46 need not be affixed to each other and instead the identification band blank may overlap itself and be secured with a single tab 44 or 46.

Figure 5:
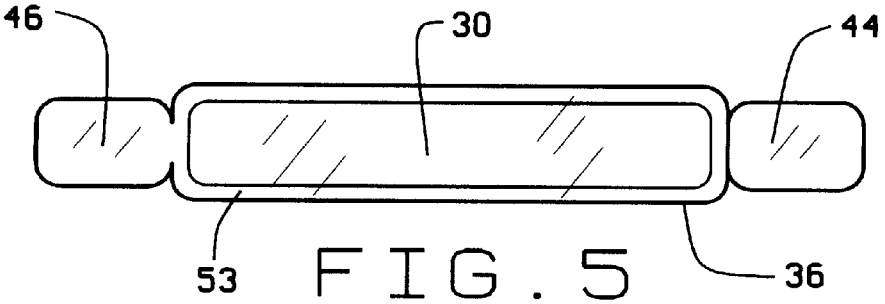
FIG. 5 is a plan view of an assembled identification band blank of the present invention.

In operation, for example, as the present invention is adapted to a hospital admission of a patient, the appropriate information is taken from the patient and the computer causes the laser printer to preprint the label portion of the identification band blank. Then, following the easy instructions as shown in Index A, the identification band blank is separated both from the paper side as well as the transparent film side of the multi-layered form to arrive at a separated, but unassembled identification band blank as shown at 51. To complete the preassembly of the identification band blank, the upper half 40 of the transparent film layer is folded about fold line 42 to overlie the paper label 30 and adhere to the adhesive side of the lower half 38. This completed construction is shown in FIG. 5. As shown therein, the paper label portion 30 has a silhouette which is narrower than the width of the folded over transparent film layer such that an adhesive-to-adhesive seal completely surrounds and encapsulates the paper label portion 30. In other words, a picture frame 53 of sealed halves of the transparent film surround the paper label portion 30. This provides optimum moisture proofing and a protective layer of transparent film overlying the laser printed information contained in the identification band blank.

The identification band blank may then be applied to a patient's wrist by looping it therearound, overlapping tabs 44, 46, such that their adhesive surfaces align with each other and are secured to each other. This provides maximum sealing and fastening strength which, although not completely tamperproof, requires a concerted effort in order to separate and remove the identification band blank. For patients with smaller wrists, the band blank may be overlapped as it encircles the wrist and the tabs adhered to the body of the band blank.

Various changes may be made to the invention as would be apparent to those skilled in the art. However, the invention is limited only by the scope of the claims appended hereto, and their equivalents.

INDEX A

INSTRUCTIONS

STEP 1 Print bracelet and labels on laser printer.

STEP 2 Push lower edge of bracelet down to start to separate imaged bracelet from sheet.

STEP 3 Turn sheet over and carefully pull bracelet with clear film from sheet—start from the left and pull to the right.

STEP 4 Turn bracelet over and fold clear film over wrist band to seal imaged area.

What is claimed is:

1. An identification band blank, cut into and removable from a multi-layered form suitable for processing through a computer controlled printer, said multi-layered blank having a first layer suitable for receiving a print image from said printer, a second, over-sized layer of moisture resistant material, and a pair of integrally formed adhesive backed tabs cut into and formed out of the material comprising the second layer and near the ends of said band blank so that upon removal of said band blank from said form the second layer may be folded over to overlie the printed image on the first layer and the tabs used to secure the band blank about a person's appendage.

2. The identification band blank of claim 1 wherein the second layer has an adhesive applied thereto, and the first layer is releasably adhered to said second layer by said adhesive.

3. The identification band blank of claim 2 wherein the second layer comprises a substantially transparent film so that as said second layer is folded over the first layer the printed image is viewable therethrough.

4. The identification band blank of claim 3 wherein the first layer is thicker than the second layer, the first layer being comprised of paper stock.

5. The identification band blank of claim 4 wherein the entire form is comprised of the same materials as said first and second layers.

6. The identification band blank of claim 4 wherein said tabs are positioned at the ends of said second layer, said first and second layers being substantially the same length and wherein said layers are sized to fit around an average sized person's wrist, and said tabs being arranged so that their respective adhesive sides face each other as the band blank is applied to a person.

7. The identification band blank of claim 6 wherein said first and second layers are sized so that as said second layer is folded over said first layer, said first layer is entirely surrounded by said second layer.

8. The identification band blank of claim 7 wherein said second layer includes a fold line substantially dividing it into an upper and a lower half so that as said second layer is folded about said fold line the second layer entirely surrounds the first layer.

9. The identification band blank of claim 1 further comprising a plurality of adhesive backed labels formed in a first portion of said page sized forms and wherein said band blank is formed in a second portion of said page sized form.

10. The identification band blank of claim 9 further comprising a line of perforation separating said first portion from said second portion for facilitating their ready detachment from each other.

11. The Identification band blank of claim 10 wherein said perforation line extends through at least the top layer of said first portion.

12. An identification band blank cut into and removable from a page-sized, multi-layered form, said band blank including a first layer adapted to receive and hold a printed image thereon, and a second layer of a substantially transparent, adhesive-backed film and sized to overly both sides of said first layer with a pair of tabs at the ends of said second layer for adjustably attaching, together the ends of said band blank.

13. The identification band blank of claim 12 wherein said entire form is comprised of substantially the same material as said first and second layers, said first and second layers being defined by die cuts into said form.

14. The identification band blank of claim 12 wherein the second layer is greater than twice the width of the first layer so that said second layer entirely encapsulates said first layer as the second layer is folded over the first layer.

15. The identification band blank of claim 14 wherein the first layer is comprised of a paper stock and said second layer is comprised of a substantially transparent adhesive-backed film.

16. The identification band blank of claim 15 wherein said second layer includes a notch at either end as an aid in separating said second layer from said form.

17. The identification band blank of claim 16 wherein said second layer includes a fold line extending between said notches and about which said second layer may be folded to encapsulate said first layer.

18. The identification band blank of claim 15 further comprising a die cut in each of said first and second layers defining a second, shorter length band blank, said second die cuts requiring greater tensile force to separate than the longer length band blank.

19. The identification band blank of claim 12 further comprising a plurality of adhesive backed labels formed in a first portion of said page sized forms and wherein said band blank is formed in a second portion of said page sized form.

20. The identification band blank of claim 19 further comprising a line of perforation separating said first portion from said second portion for facilitating their ready detachment from each other.

21. The identification band blank of claim 20 wherein said perforation line extends through at least the top layer of said first portion.

22. A multi-layered identification band blank with a pair of adhesive backed tabs die cut into a page-sized form, said band blank being separable from said form at said die cuts and having its layers arranged to directly receive printed information on the outside of one layer and a second substantially transparent layer for overlying said printed information, said tabs being die cut into said second substantially transparent layer and adapted to adjustably secure the ends of said band blank at different positions to accommodate different desired circumferences.

23. The identification band blank of claim 22 wherein said second layer is substantially moisture proof and sized to completely encapsulate said first layer.

24. The identification band blank of claim 23 wherein said tabs are adhesively backed and arranged to overlie with their adhesive surfaces abutting as the band blank is wrapped into a circle.

25. The identification band blank of claim 24 wherein said page-sized form is comprised entirely of material the same as said first and second layers.

26. The identification band blank of claim 22 further comprising a plurality of adhesive backed labels formed in a first portion of said page sized forms and wherein said band blank is formed in a second portion of said page sized form.

27. The identification band blank of claim 26 further comprising a line of perforation separating said first portion from said second portion for facilitating their ready detachment from each other.

28. The identification band blank of claim 27 wherein said perforation line extends through at least the top layer of said first portion.

29. A page sized form suitable for processing through a computer controlled printer comprised of a first portion having a plurality of adhesive backed labels and a second portion comprising an identification band blank having a first layer suitable for receiving a print image on a surface thereof from said printer, a second layer of moisture resistant material for overlying and sealing said surface, and said second layer having a pair of integrally formed tabs for securing said band blank about a person's appendage.

30. The form of claim 29 further comprising a line of perforation separating said first and second portions.

31. An identification band blank defined in a page sized form suitable for processing through a computer controlled printer comprising a first layer suitable for receiving a print image on a surface thereof from said printer, a second layer of moisture resistant material for overlying and sealing said surface, and said second layer having a pair of integrally formed tabs for securing said band blank about a person's appendage.

* * * * *